United States Patent [19]

Matsumoto et al.

[11] Patent Number: 4,610,944

[45] Date of Patent: Sep. 9, 1986

[54] PRODUCTION OF TONER

[75] Inventors: Toru Matsumoto, Tokyo; Masuo Yamazaki; Katsutoshi Wakamiya, both of Yokohama, all of Japan

[73] Assignee: Canon Kabushiki Kaisha, Tokyo, Japan

[21] Appl. No.: 567,498

[22] Filed: Jan. 3, 1984

[30] Foreign Application Priority Data

Jan. 12, 1983 [JP] Japan ..... 58-3031
Jan. 12, 1983 [JP] Japan ..... 58-3032

[51] Int. Cl.[4] ..... G03G 9/00
[52] U.S. Cl. ..... 430/135; 430/109
[58] Field of Search ..... 430/137, 109

[56] References Cited

U.S. PATENT DOCUMENTS 2,221,776 11/1940 Carlson .
2,618,552 11/1952 Wise .
2,874,063 2/1959 Greig .
4,329,415 5/1982 Ikeda et al. ..... 430/137

FOREIGN PATENT DOCUMENTS 130761 10/1981 Japan ..... 430/137
1520047 9/1978 United Kingdom .

*Primary Examiner*—John L. Goodrow
*Attorney, Agent, or Firm*—Fitzpatrick, Cella, Harper & Scinto

[57] ABSTRACT

A process for producing a toner, comprising the steps of suspending a molten mixture of starting materials of a binder containing a compound having a hydrocarbon chain and a colorant in an aqueous dispersing medium in the presence of a hardly water-soluble fine powdery inorganic dispersant, cooling the dispersed particles, and recovering the cooled particles.

38 Claims, No Drawings

PRODUCTION OF TONER

BACKGROUND OF THE INVENTION

1. Field of the Invention

This invention relates to a process for producing a toner to be used in electrophotography, electrostatic photography, magnetic recording, electrostatic printing, etc.

2. Description of the Prior Art

The operation of so-called "fixing" has been practiced in the art when it is desired to store an image of colored fine powder called "toner", which image has been obtained by developing an electrostatic or magnetic latent image. As such fixing methods, a method in which toner on a latent image bearing surface as such or after being transferred onto a transfer material such as paper is heated in a heat chamber to melt and embed the toner simultaneously; a method in which toner is dissolved with the use of a solvent to effect adhesion of the toner and thereafter the solvent is removed; a method in which a resin solution called a fixing liquor is applied and fixed on the image; and other methods, have been known.

On the other hand, as a developing method for visualization of electric latent images with toner, a large number of methods have been known such as the magnetic brush method disclosed in U.S. Pat. No. 2,874,063, the cascade developing method disclosed in U.S. Pat. No. 2,618,552, the powder cloud method disclosed in U.S. Pat. No. 2,221,776, the fur brush method and the liquid developing method. The toner to be used in these developing and fixing methods is constituted so as to satisfy the various developing and fixing methods as mentioned above and give sufficient performance. For such purposes, it has been practiced in the art to mix a colorant such as carbon black or iron oxide with a binding material such as polystyrene or phenol resin, crushing the mixture into minute powder, and after carrying out optionally the operation of classification, etc., mixing the powder with carrier particles such as a magnetic material or glass beads or an electroconductive agent, if desired depending on the respective developing method, to be provided for use.

As toner to be used in such a form, various kinds of toner have been known in the art. They are constituted so as to be adapted for developing methods and fixing methods as described above. Toner is constituted in a form so as to satisfy such developing characteristic and fixing characteristic, but it is generally difficult for a toner to have well-balanced developing characteristic and fixing characteristic.

This is because there are essential properties required for a toner which are basically incompatible with each other, namely an ability of adhesion and agglomeration required for fixing and or ability of individual and independent movement of toner particles required for development.

In particular, such essential but basically incompatible properties are more severely required recently when there are increasing demands for a high performance toner, a toner capable of developing and fixing at high speed and a toner which can be fixed with a low energy (e.g. very slight pressure). Thus, if a toner having a better fixing characteristic is desired, it becomes more difficult to give a satisfactory developing characteristic to the toner.

For overcoming such a contradiction, a toner in the form of a capsule having developing characteristic and fixing characteristic separated into a shell and a core, respectively, is also proposed. However, practically, it is not necessarily easy to prepare an ultra-fine particulate form of capsule adapted for toner.

Also, as described above, the toner of the prior art has been generally produced by melt-mixing a thermoplastic resin with a colorant such as a dye or a pigment at a high temperature, cooling the resultant mixture to room temperature and crushing the cooled product into fine particles. However, the toner produced according to such a process has no constant shape or size on account of the nature of the process, and it is also essentially difficult to obtain uniformness between toner particles as well as homogenity in each toner particle. In sufficiency in practical performance caused by such shortcomings has appeared in various forms.

Production of the toner according to such a process also requires a large amount of cost. In particular, the step for preparing minute particles has required a large amount of energy, thus taking a large part of the production cost in respect of both installation cost and running cost.

According to such a process, there has also been a great restriction with respect to the materials to be employed. For example, for obtaining a fine particulate toner with a homogeneous composition, kneading must be done to a considerable extent of homogenity, whereby a material adapted for kneading must be used.

On the other hand, for obtaining a fine powdery toner, crushing characteristic of the materials has posed a great problem in productivity. More specifically, to be made into a toner, the binder used therefore is first required to have fragility, which, however, did not coincide with the characteristics of the binder required from the aspect of the toner performance. In other words, it has not been possible to use a binder having desired characteristics only from the standpoint of the requisite performance of a toner in the process of the prior art.

In order to solve these problems, a process utilizing so-called emulsion polymerization is also proposed, in which particles are formed simultaneoulsly with polymerization to give toner particles. However, when a toner is produced by such a process, it is difficult to completely remove the emulsifier or dispersant employed for stabilization of dispersion, and therefore a toner with sufficient performances could hardly be obtained.

SUMMARY OF THE INVENTION

An generic object of the present invention is to provide a process for producing a toner having overcome the problems as mentioned above of the process of the prior art.

A specific object of the present invention is to provide a process for producing a toner having particularly excellent pressure fixing characteristic and good developing performance.

Another object of the present invention is to provide a process for producing a toner which can give stable performance even when employed repeatedly, without causing contamination of carriers, a metal sleeve or the surface of the photo sensitive member.

Still another object of the present invention is to provide a pressure-fixable toner without causing off-set to the pressure roller and also free from contamination on carriers, developing sleeve and photosensitive member.

Further, it is also another object of the present invention to provide a process for producing a toner which is stable even when used for a large number of times, and also stable during storage for a long term without denaturation within a storing vessel.

Also, still another object of the present invention is to provide a process for producing a toner having a uniform shape and a homogeneous composition.

Also, still another object of the present invention is to provide a process for producing toner particles with a pigment uniformly dispersed therein.

A further object of the present invention is to provide a less expensive process for producing a toner.

According to another aspect of the invention, a toner having the characteristics as mentioned above is also provided.

The process for producing a toner of the invention according to its broadest mode comprises the steps of: suspending a molten mixture of starting materials of a binder containing a compound having a hydrocarbon chain and a colorant in an aqueous dispersing medium in the presence of a hardly water-soluble fine powdery inorganic dispersant, cooling the dispersed particles, and recovering the cooled particles.

According to a preferred embodiment, the process of the present invention comprises the steps of: suspending a molten mixture of starting materials of a binder containing a compound having a hydrocarbon chain and a colorant in an aqueous dispersing medium in the presence of a hardly water-soluble fine powdery inorganic dispersant, coating the particle surfaces after suspension with a resin, cooling the dispersed particles coated with a resin, and recovering the cooled particles.

According to another preferred embodiment, in the combination of the starting material mixture and the inorganic dispersant, the starting material mixture in (a) cationically charged in water by addition of a cationic compound or a hardly water-soluble organic amine compound or (b) anionically charged by addition of an anionic compound, and the inorganic dispersant is charged to a polarity opposite to that of the starting material mixture With the use of such a combination, the above-mentioned inorganic dispersant is firmly bonded through ionic bonding around the particles of the material mixture to uniformly cover the material mixture particles, whereby undesirable coalescence of the dispersed particles, etc. can be prevented. According to this process, a toner having a more uniform particle size distribution can be obtained.

A method in which fine particles are obtained by being dispersed into water has heretofore been known. According to such a method, there is employed a step of dispersing a molten mixture of starting materials into hot water in the presence of a surfactant or a stabilizer to form particles. An example of such methods for producing fine particles is disclosed by Japanese Laid-Open Application No. 138735/1976. By using this method fine particles can be obtained, but it is difficult to obtain a desired particle size distribution. The particle size can be controlled to some extent by selection of dispersing conditions and kinds of dispersants. It is difficult, however, to obtain such a particle size of the order of 3 to 30 μm as desired for a toner, the production of which is the principal object of the invention. Especially, it is almost impossible to control the distribution of the particle size which is required if the particles are used as a toner. Thus, when one wants to obtain a desired particle size, there are also produced particles with much larger sizes and much smaller sizes, and a toner with an insufficient distribution, thus insufficient performances, is obtained. Such insufficient control of particle size has been considered to be a problem inherent to a conventional dispersion system using an organic dispersant due to surface activation effect of dispersant molecules.

Besides, a conventional organic dispersant or surfactant adheres to the resultant particles. Such an organic dispersant has both hydrophilic and lipophilic groups and the remaining thereof, even if it is in a small amount, give seriously ill effects to the performances of the resultant toner. Accordingly, such organic dispersants should be completely removed but it is difficult, and reuse or disposal through treatment thereof is also difficult. In contrast to the above, the process according to the present invention is a process in which toner particles are prepared by fusion mixing of the starting material mixture and dispersing the molten mixture with the use of an inorganic dispersant. According to the process of the invention using an inorganic dispersant, control of particle size and its distribution is made possible, and the removal of the dispersant is very easy.

The present invention will be described in further detail. In the description appearing hereinafter, "%" and "parts" representing the proportional ratios are by weight, unless otherwise specifically noted.

DETAILED DESCRIPTION OF THE INVENTION

In the present invention, the compounds having hydrocarbon chains (hereinafter frequently referred to as "long-chain compounds") may be inclusive of hydrocarbons, fatty acids, esters, metal soaps metal salts or chlorides of fatty acids, fatty alcohols, polyhydric alcohols, fluorides, amides, and bisamides containing 12 to 50 carbon atoms. These are commercially available under the names of Paraffin Wax, Microcrystalline Wax and Amide Wax.

More specifically, long-chain compounds having hydrocarbon chains may include the following:

(1) Normal- and iso-paraffins represented by $C_nH_{2n+2}$ (n=12–50) and compounds having some unsaturated bondings therein: examples are set forth below (those having an unsaturated bonding are noted with (−2H):

| | |
|---|---|
| $C_{12}$ | n-Dodecane |
| $C_{12}(-2H)$ | 1-Dodecene |
| $C_{13}$ | n-Tridecane |
| $C_{13}(-2H)$ | 1-Tridecene |
| $C_{14}$ | n-Tetradecane |
| $C_{14}(-2H)$ | 1-Tetradecene |
| $C_{15}$ | n-Pentadecane |
| $C_{15}(-2H)$ | 1-Pentadecene |
| $C_{16}$ | n-Hexadecane |
| $C_{16}(-2H)$ | 1-Hexadecene |
| $C_{18}$ | n-Octadecane |
| $C_{18}(-2H)$ | 1-Octadecene |
| $C_{19}$ | n-Nonadecane |
| $C_{19}(-2H)$ | 1-Nonadecene |
| $C_{20}$ | n-Eicosane |
| $C_{20}(-2H)$ | 1-Eicosene |
| $C_{22}$ | n-Docosane |
| $C_{24}$ | n-Tetracosane |
| $C_{28}$ | n-Octacosane |
| $C_{32}$ | n-Dotriacontane |
| $C_{36}$ | n-Hexatriacontane |

Other compounds such as squalene $C_{30}H_{50}$, squalane 2, 6, 10, 15, 19, 23, hexamethyltetracosane ($C_{30}H_{62}$) are also included.

(2) Fatty acids corresponding to the hydrocarbons shown in the above (1) and esters or metal soaps thereof.

The binder providing the starting material mixture to be used in the present invention may be a long-chain compound alone selected from those set forth above, or alternatively a binder resin for toner conventionally used in the art such as styrene type resin may also be used in combination at a ratio of up to 70% of the whole binder.

The colorant for providing the starting material mixture in combination with the above-mentioned binder may include colorants comprising various dyes and pigments, for example, carbon black. In addition, magnetic powder may also be used as a colorant, which can be used to make the toner of the present invention a magnetic toner. The amount of the colorant is not particularly limited, as far as an appropriate color toner can be imparted to the toner. The amount of a magnetic material for providing a magnetic toner may suitably be about 15 to 70% of the toner weight.

The toner of the present invention can be prepared generally by dispersing a molten mixture of the respective components as described above in an aqueous dispersing medium heated to about 60° to 99° C. in the presence of an inorganic finely pulverized dispersant.

The inorganic dispersant is an inorganic compound hardly soluble in water in finely pulverized form, including hardly soluble salts in water such as $BaSO_4$, $CaSO_4$, $BaCO_3$, $CaCO_3$, $MgCO_3$ and $Ca_3(PO_4)_2$, inorganic macromolecular compounds such as talc, bentonite, silicic acid, diatomaceous earth, clay, aluminumoxide, and $SiO_2$, powder of metals or metal oxides. The inorganic dispersant may have particle sizes as small as possible, since sufficient effect can be exhibited with the use of a minute amount thereof, preferably a mean particle size of 10$\mu$ or less, particularly 2$\mu$ or less.

In the particularly preferred embodiment of suspension or dispersion of the present invention, the inorganic dispersant employed has a charging characteristic opposite to that of the starting material mixture. For this purpose, the starting material mixture is first made cationically or anionically chargeable. For making the starting material mixture cationically chargeable, a cationic compound or an organic amine compound hardly soluble in water may be added in the starting material mixture.

Cationic compounds are, for example, polymers comprising nitrogen-containing polymerizable monomers as constituent units therein. Examples of the nitrogen containing monomers are shown below:

Dimethylaminoethyl methacrylate,
Diethylaminoethyl methacrylate,
Dibutylaminoethyl methacrylate,
Dimethylaminoethyl acrylate,
2-Hydroxy-3-methacryloxypropyl trimethylammonium chloride,
2-Hydroxy-3-acryloxypropyl trimethylammonium chloride,
Diacetone acrylamide,
Acrylamide,
N-vinylcarbazole,
Vinylpyridine,
2-Vinylimidazole,
Diethylaminoethyl methacrylate,
Diethylaminoethyl acrylate,
N-n-butoxyacrylamide These cationic polymers may be homopolymers of the above monomers or copolymers of these monomers with other copolymerizable monomers. The above monomer may be also graft polymerized onto a long-chain compound to give a cationic long-chain compound.

Hardly water-soluble organic amines may include:

aliphatic primary amines having 7 or more carbon atoms such as heptylamine, octylamine, dodecylamine, etc.;

aliphatic secondary amines having a boiling point of 80° C. or higher such as dipropylamine, diisopropyl amine, dibutylamine, diamylamine, didodecylamine, etc.;

aliphatic tertiary amines having a boiling point of 80° C. or higher such as triethylamine, tripropylamine, tributylamine, triamylamine, n-dodecyldimethylamine, n-tetradecyldimethylamine, etc.;

aromatic amines such as aniline, methylaniline, dimethylaniline, ethylaniline, diethylaniline, toluidine, dibenzylamine, tribenzylamine, diphenylamine, triphenylamine, naphthylamine, etc.

On the other hand, for making the starting material mixture anionically chargeable, an anionic compound may be incorporated in the starting material mixture. Anionic compounds may be inclusive of polymers (homopolymers or copolymers) comprising polymerizable monomers as shown below as the constituent units;

2-Acrylamido-2-methylpropane sulfonic acid,
N-methylolacrylamide,
Methacrylic acid,
Acrylic acid,
2-Hydroxyethyl methacrylate,
2-Hydroxypropyl methacrylate,
Glycidyl methacrylate,
Polypropyleneglycol monomethacrylate,
Polyethyleneglycol monomethacrylate,
Tetrahydrofuryl methacrylate,
Acid phosphooxyethyl methacrylate These polymers may be used as a mixture with the long-chain compound as mentioned above, or alternatively the above monomer may be graft polymerized onto the long-chain compound to give an anionic long-chain compound.

The additive for providing a cationically or anionically chargeable starting material mixture may be considered generally as a part of the binder component, and it may be added at a ratio of 0.01 to 10% of the binder. Also, these additives should preferably be controlled in degree of polymerization and/or amounts added so as to make the melting point of the binder as a whole to the range from 60° to 120° C.

On the other hand, the anionic inorganic dispersant to be used in combination with a cationically chargeable starting material mixture may include colloidal silica ($SiO_2$), bentonite ($SiO_2/Al_2O_3$) and others. For example, those known as colloidal silica have a mean diameter of primary particles ranging from 40 m$\mu$ to 7 m$\mu$ and exhibit a pH value of 3.6 to 4.3 at a concentration of 4% in water. Commercially available products are, for example, Aerosil #200 (Nihon Aerosil K.K.), Aerosil #300, 380, HDK V15, HDK N20, etc.

The cationic inorganic dispersant to be used in combination with the anionically chargeable starting material mixture may be aluminum oxide ($Al_2O_3$), etc. For example, Aluminum Oxide C which is an aluminum oxide product available from Degussa Co., West Germany, is very fine with a mean size of primary particles of 20 mμ and of high purity. Aluminum Oxide C exhibits an isoelectric point of about pH 9 and it is used in a neutral or acidic dispersing medium.

In the process of the present invention, the inorganic dispersant, including both anionic and cationic inorganic dispersants as mentioned above, may be used in an amount adapted for giving a desired particle size and its distribution selected from the range of from 0.01 to 10 parts, preferably 0.05 to 10 parts, per 100 parts of the starting material mixture.

Use of an inorganic dispersant having a charging characteristic opposite to that of the starting material mixture according to a preferred embodiment of the present invention as described above is preferable for the following reason. Thus, in this system, the particles of the starting material mixture are charged cationically or anionically at their interfaces to form stable agglomerates through interaction with the above-mentioned inorganic dispersant. In other words, the surfaces of the suspended or dispersed particles are coated completely uniformly with the inorganic dispersant firmly bonded thereto due to ionic bonding, whereby coalescence between particles can be prevented.

In the case of the inorganic dispersant thus firmly bonded through ionic bonding, outstanding superiority can be seen as compared with the methods of the prior art, wherein the dispersant is merely adsorbed onto the polymer particles or dispersed between particles to prevent coalescence.

Thus, the following advantages are obtained:

(1) By changing the stirring speed, the amount of the ionic material and the amount of the inorganic dispersant suitably as desired, the desired particle size can freely be set.

(2) Due to absence of coalescence of particles, the particle size distribution of the particles formed in narrow.

(3) Productivity can be made larger, because the ratio of the particles relative to water can be increased.

(4) Formation of particles at a low stirring speed is rendered possible.

In the aqueous dispersing medium, it is also possible to incorporate, other than the inorganic dispersant as described above, an acid or alkali for pH control or a surfactant for promoting dispersion of the dispersant per se.

For effective suspension, in addition to choice of the above-mentioned dispersant, stirring is another important condition, and an appropriate condition for stirring is important and selected depending on the purpose, because the sizes of the particles and stability of the particles are determined thereby. More specifically, control of the particle sizes is greatly influenced by the intensity of stirring and the kind of the stirring blade employed. Generally speaking, as the stirring is made more vigorous, particles with smaller sizes can be obtained. However, there is a lower limit with respect to the size attainable in industrial application and yield is also lowered due to entrainment of the air into the stirring device.

The present inventors have made extensive studies to obtain minute polymer particles, and consequently found that, in order to form such minute particles, it is very effective to use a dispersing device, comprising a rotary blade (turbine) having a high shearing force and rotatable at a high speed and a fixed blade (stator), which effects dispersion through powerful shearing force created between minute gaps which are precise and uniform. As examples of such a device, there are TK homomixer, TK pipeline homomixer (mfd. by Tokushu Kika Kogyo K.K.) and Microagitor (mfd. by Shimazu Seisakusho K.K.).

When sufficient stirring is continued in heated water in the presence of an inorganic dispersant, the particle sizes of the starting material mixture will become gradually more minute and uniform. This is confirmed by, for example, observation of particles intermittently sampled. In a typical example, the particles sampled 15 to 30 minutes after stirring were found to have a broad particle size distribution, but 30 minutes to 60 minutes thereafter, all coarse particles disappeared to be unifomly formed into minute particles.

By cooling and recovering the particles of the starting material mixture dispersed with uniform particle sizes as described above, the toner of the present invention can be obtained. Cooling may be effected by externally cooling the heated dispersion as prepared above, or alternatively by throwing cold water into the dispersion, or more preferably by throwing the dispersion into cold water to quench the dispersion.

As remarkable specific features, the toner of the present invention thus prepared has a uniform particle size distribution as described above and a shape like true sphere. For these reasons, the toner is excellent in free flowing property and easy to handle. Moreover, in the case of the particles obtained according to the suspension method employing a dispersant having a charging characteristic opposite to that of the starting material mixture, particularly good free flowing property can be obtained. This may be attributable to the phenomenon that the toner particles are formed under the state where minute particles of the inorganic dispersant adhere around the particles of the starting material mixture.

According to a preferred embodiment of the present invention, the colored particles (core particles) as prepared above are coated with a shell-forming resin to provide a microcapsule toner. Such microencapsulation is preferred for obtaining a toner well balanced in developing characteristic and fixing characteristic and also well balanced in off-set resistance and fixing characteristic, and further for obtaining a toner with good storage stability. As described above, since the colored particles for core particles are true-spherical and have a uniform particle size distribution, more uniform resin coating can advantageously be effected by microencapsulation.

As the shell materials, known resins may be available, including homopolymers of styrene and substituted derivative thereof such as polystyrene, poly-p-chlorostyrene, polyvinyltoluene and the like; styrene copolymers such as styrene-p-chlorostyrene copolymer, styrene-propylene copolymer, styrene-vinyltoluene copolymer, styrene-vinylnaphthalene copolymer styrene-methyl methacrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer and the like; polymethyl methacrylate; polybutyl methacrylate; polyvinyl chloride; polyvinyl acetate; polyethylene; polypropylene, polyester; polyurethane; polyamide; epoxy resin; polyvinyl butyral; rosin; modified rosin; terpene resin; phenol resin; aliphatic or alicyclic hydrocarbon resin; aromatic petroleum resin; urea resin; melamine resin; and so on. These resins may be used either singly or as a mixture.

Any microencapsulation method known in the art may be applicable. For example, there may be employed the spray drying method, the drying-in-liquid method, the phase separation method and the in-situ polymerization method. A multi-layer shell structure may also be provided in order to impart insulating property and appropriate triboelectric charging characteristic to the toner of the present invention.

Further, the microcapsule toner can contain various dyes, pigments and magnetic powder, which may be incorporated in either one or both of the core material and the shell material.

The toner of the present invention obtained after a series of the steps as described above has a mean particle size generally in the range from 3 to 30$\mu$, and it is suitable for the shell material in the case of microcapsule to have a thickness of about 0.001 to 1$\mu$.

The toner of the present invention may be used, for example, as a developer for electrical latent images, etc. optionally admixed with carrier particles such as iron powder, glass beads, nickel powder and ferrite powder. Also, it can be mixed with fine powder of hydrophobic colloidal silica for the purpose of improvement of free flowing property of the powder, or fine particles of an abrasive such as cerium oxide for the purpose of preventing attachment of toner.

EXAMPLE 1

| | |
|---|---|
| Paraffin (melting point: 70° C.) | 100 parts |
| Carbon black (Regal 400R, Cabot Co.) | 10 parts |
| Dodecylamine | 0.5 part |

The above materials were melted and kneaded under heating. On the other hand, 8 g of fine particulate silica (Aerosil 200, particle size 12 m$\mu$, specific surface are 200 $m^2/g$), was charged into a 2 l-glass vessel and 500 ml of distilled water was added thereto. The resultant mixture was heated to 95° C. under stirring by means of TK homomixer at 2000 rpm. Into this mixture was thrown 25 g of the above mixture, followed further by stirring at an increased rotational speed of 6000 rpm for 90 minutes. Then, after throwing the dispersion into 1l of cold water, the product was filtered and dried, and the colored particles were taken out to provide toner.

The toner thus obtained had a weight-average particle size of 12$\mu$ and a weight basis standard deviation of the size was 1.5.

The toner was used for developing a negative electrostatic latent image to give a clear image, which was then completely fixed by using pressure-fixing rollers with a line pressure of 15 kg/cm.

EXAMPLE 2

| | |
|---|---|
| Microcrystalline wax (m.p.: 85° C.) | 100 parts |
| Magnetite | 50 parts |
| Styrene/diethylaminoethyl | 1 part |

-continued

| |
|---|
| methacrylate copolymer |

The above material were melted and kneaded under heating. On the other hand, 8 g of the fine particulate silica (Aerosil 200) was charged into a 2 l-glass vessel and 500 ml of distilled water was added thereto. Following subsequently the same procedure as described in Example 1, except for using the above molten mixture, a toner was similarly prepared.

The toner had an average particle size of 15$\mu$ and the standard deviation thereof was 1.5.

The toner was used for developing by using a developer machine having a magnetic sleeve to give a clear image, which was then pressure-fixed as in Example 1.

EXAMPLE 3

Example 1 was repeated except that 10 g of Aerosil 200 was used to obtain fine colored particles. After 100 g of the fine colored particles were dispersed in 200 l of a 5% solution of a styrene-butyl acrylate resin in xylene, the dispersion was sprayed through a spray drier to coat the surfaces of the particles with the resin. The resultant powder substantially the same size distribution as that of the uncoated particles and the observation thereof by an electronic microscope showed that the particles were uniformly coated with the resin. The powder was also found to have very good free flowing property.

100 Parts of this fine powder were mixed with 0.6 part of ultra-hydrophobic colloidal silica, followed by stirring to provide a developer.

This developer was used for developing a positive electrostatic latent image to give a clear image. The development was repeated continuously for 1500 sheets to give completely unchanged images. The images were satisfactorily fixed under a line pressure of 15 kg/cm and the fixability did not change even after 1500 sheets of copying.

EXAMPLE 4

| | |
|---|---|
| Paraffin (m.p. 75° C.) | 80 parts |
| Polyethylene (m.p. 95° C.) | 20 parts |
| Magnetite | 50 parts |
| Dibutylamine | 0.5 part |

The above components were melted and kneaded under heating. In a glass vessel were placed 5 g of Aerosil 200 and 400 ml of water, and the formation of fine particles was similarly conducted material mixture. The fine particles obtained were dispersed in a 5% solution of a styrene/diethylaminoethyl methacrylate copolymer dissolved in DMF, and resin coating was applied through phase separation on the surfaces of the minute particles.

The coated particles were found to have substantially the same particle size distribution and the uniform coating was confirmed by the observation through an electronic microscope.

Next, 100 parts of the above toner were mixed with 0.6 part of hydrophobic microparticulate silica to provide a developer, which was employed for development of an electrostatic latent image on a photoconductive member to give a very clear image. Then, the toner image was transferred onto paper and passed through a fixing machine under a line pressure of 15 kg/cm, whereby the image was completely fixed.

What is claimed is:

1. A process for producing a toner and having a controlled and more uniform particle size distribution, comprising the steps of:

melting a mixture of a long-chain binder compound having a melting point above room temperature, and a colorant;

adding the molten mixture to a heated aqueous dispersing medium in the presence of a substantially water-insoluble fine powdery inorganic dispersant;

stirring the added molten mixture and said aqueous dispersing medium to form suspended particles of said molten mixture dispersed in the aqueous dispersing medium;

cooling the dispersed particles of said mixture;

recovering the cooled particles.

2. A process according to claim 1, wherein the long-chain binder compound is selected from the group consisting of hydrocarbons, fatty acids, esters, metal soaps, metal salts or chlorides of fatty acids, fatty alcohols, polyhydric alcohols, fluorides, amides, and bisamides containing 12 to 50 carbon atoms, 3. A process according to claim 1, wherein the fine powdery inorganic dispersant is fine particles selected from the group consisting of $BaSO_4$, $CaSO_4$, $BaCO_3$, $CaCO_3$, $MgCO_3$, $Ca_3(PO_4)_2$, talc, bentonite, silicic acid, diatomaceous earth, clay, aluminum oxide and $SiO_2$.

4. A process according to claim 1, wherein the aqueous dispersing medium is heated to about 60° to 99° C.

5. A process for producing a toner, comprising the steps of:

melting a mixture of a long-chain binder compound having a melting point above room temperature and a colorant, said mixture being chargeable either cationically or anionically;

adding the molten mixture to a heated aqueous dispersing medium in the presence of a substantially water-insoluble fine powdery inorganic dispersant, said dispersant being chargeable to a polarity opposite to that of said mixture;

stirring the added molten mixture and said aqueous dispersing medium to form suspended particles of said molten mixture dispersed in the aqueous dispersing medium;

cooling the dispersed particles of said mixture; and recovering the cooled particles.

6. A process according to claim 5, wherein the long-chain binder compound is selected from the group consisting of hydrocarbons, fatty acids, esters, metla soaps, metal salts or chlorides of fatty acids, fatty alcohols, polyhydric alcohols, fluorides, amides, and bisamides containing 12 to 50 carbon atoms.

7. A process according to claim 5, wherein the fine powdery inorganic dispersant is fine particles selected from the group consisting of $BaSO_4$, $CaSO_4$, $BaCO_3$, $CaCO_3$, $MgCO_3$, $Ca_3(PO_4)_2$, talc, bentonite, silicic acid, diatomaceous earth, clay, aluminum oxide and $SiO_2$.

8. A process according to claim 5, wherein the aqueous dispersing medium is heated to about 60° to 99° C.

9. A process according to claim 5 wherein the mixture contains a cationic compound or a substantially water-insoluble organic amine compound and is used in combination with an anionic inorganic dispersant.

10. A process according to claim 9, wherein the cationic compound is a cationic polymer.

11. A process according to claim 9, wherein the cationic compound is a cationic monomer graft polymerized onto the long-chain binder compound.

12. A process according to claim 9, wherein the anionic inorganic dispersant is selected from the group consisting of colloidal silica and bentonite.

13. A process according to claim 5, wherein the mixture contains an anionic compound and is used in combination with a cationic inorganic dispersant.

14. A process according to claim 13, wherein the anionic compound is an anionic polymer.

15. A process according to claim 13, wherein the anionic compound is an anionic monomer graft polymerized onto the long-chain binder compound.

16. A process according to claim 13, wherein the cationic inorganic dispersant comprises aluminum oxide particles.

17. A process for producing a toner, comprising the steps of:

melting a mixture of a long-chain binder compound having a melting point above room temperature and a colorant;

adding the molten mixture to a heated aqueous dispersing medium in the presence of a substantially water-insoluble fine powdery inorganic dispersant;

stirring the added molten mixture and said aqueous dispersing medium to form suspended particles of said molten mixture dispersed in the aqueous dispersing medium;

cooling the dispersed particles of said mixture;

recovering the cooled particles; and coating the recovered particles with a resin.

18. A process according to claim 17, wherein the long-chain binder compound is selected from the group consisting of hydrocarbons, fatty acids, esters, metal soaps, metal salts or chlorides of fatty acids, fatty alcohols, polyhydric alcohols, fluorides, amides, and bisamides containing 12 to 50 carbon atoms.

19. A process according to claim 17, wherein the fine powdery inorganic dispersant is fine particles selected from the group consisting of $BaSO_4$, $CaSO_4$, $BaCO_3$, $CaCO_3$, $MgCO_3$, $Ca_3(PO_4)_2$, talc, bentonite, silicic acid, diatomaceous earth, clay, aluminum oxide and $SiO_2$.

20. A process according to claim 17, wherein the aqueous dispersing medium is heated to about 60° to 99° C.

21. A process according to claim 17, wherein the resin coating is applied on the recovered particles by the phase separation method.

22. A process according to claim 21, wherein the resin coating is carried out by dispersing the recovered particles in a resin solutin and spray drying the resultant dispersion.

23. A process for producing a toner, comprising the steps of:

melting a mixture of a long-chain binder compound having a melting point above room temperature and a colorant, said mixture being chargeable either cationically or anionically;

adding the molten mixture to a heated aqueous dispersing medium in the presence of a substantially water-insoluble fine powdery inorganic dispersant, said dispersant being chargeable to a polarity opposite to that of said mixture;

stirring the added molten mixture and said aqueous dispersing medium to form suspended particles of said molten mixture dispersed in the aqueous dispersing medium;

cooling the dispersed particles of said mixture;

recovering the cooled particles; and coating the recovered particles with a resin.

24. A process according to claim 23, wherein the long-chain binder compound is selected from the group consisting of hydrocarbons, fatty acids, esters, metal soaps, metal salts or chlorides of fatty acids, fatty alcohols, polyhydric alcohols, fluorides, amides, and bisamides containing 12 to 50 carbon atoms.

25. A process according to claim 23, wherein the fine powdery inorganic dispersant is fine particles selected from the group consisting of $BaSO_4$, $CaSO_4$, $BaCO_3$, $CaCO_3$, $MgCO_3$, $Ca_3(PO_4)_2$, talc, bentonite, silicic acid, diatomaceous earth, clay, aluminum oxide and $SiO_2$.

26. A process according to claim 23, wherein the aqueous dispersing medium is heated to about 60° to 99° C.

27. A process according to claim 23 wherein the mixture contains a cationic compound or a substantially water-insoluble organic amine compound and is used in combination with an anionic inorganic dispersant.

28. A process according to claim 27, wherein the cationic compound is a cationic polymer.

29. A process according to claim 27, wherein the cationic compound is a cationic monomer graft polymerized onto the long-chain binder compound.

30. A process according to claim 27, wherein the anionic inorganic dispersant is selected from the group consisting of colloidal silica and bentonite.

31. A process according to claim 23, wherein the mixture contains an anionic compound and is used in combination with a cationic inorganic dispersant.

32. A process according to claim 31, wherein the anionic compound is an anionic polymer.

33. A process according to claim 31, wherein the anionic compound is an anionic monomer graft polymerized onto the long-chain binder compound.

34. A process according to claim 31, wherein the cationic inorganic dispersant comprises aluminum oxide particles.

35. Toner produced according to the process of claim 1.

36. Toner produced according to the process of claim 5.

37. Toner produced according to the process of claim 17.

38. Toner produced according to the process of claim 23.

* * * * *

UNITED STATES PATENT AND TRADEMARK OFFICE

CERTIFICATE OF CORRECTION

PATENT NO. : 4,610,944

DATED : September 9, 1986

INVENTOR(S) : TORU MATSUMOTO, ET AL.

It is certified that error appears in the above-identified patent and that said Letters Patent is hereby corrected as shown below:

COLUMN 2

Lines 16-17, "In sufficiency" should read --Insufficiency--.

COLUMN 4

Line 35, "soaps metal" should read --soaps, metal--.

COLUMN 11

Line 49, "metla" should read --metal--.

COLUMN 12

Line 49, "solutin" should read --solution--.

Signed and Sealed this

Twenty-eighth Day of April, 1987

*Attest:*

DONALD J. QUIGG

*Attesting Officer*

*Commissioner of Patents and Trademarks*